US006679202B2

(12) United States Patent
Nakano

(10) Patent No.: US 6,679,202 B2
(45) Date of Patent: Jan. 20, 2004

(54) MALFUNCTION DETECTING APPARATUS FOR WATER TEMPERATURE CONTROL VALVE

(75) Inventor: Kazumi Nakano, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/385,428

(22) Filed: Mar. 12, 2003

(65) Prior Publication Data

US 2003/0172882 A1 Sep. 18, 2003

(30) Foreign Application Priority Data

Mar. 15, 2002 (JP) ..... 2002-072478

(51) Int. Cl.[7] ..... F01P 7/14

(52) U.S. Cl. ..... 123/41.1

(58) Field of Search ..... 123/41.1

(56) References Cited

U.S. PATENT DOCUMENTS 6,390,031 B1 5/2002 Suzuki et al.
2002/0111734 A1 8/2002 Wakahara et al.

*Primary Examiner*—Noah P. Kamen
(74) *Attorney, Agent, or Firm*—Nixon & Vanderhye P.C.

(57) ABSTRACT

In a case where no malfunction occurs in a water temperature control valve the temperature of the pump water is controlled to accurately follow a target water temperature. In contrast, in a case where the rotational opening degree of the water temperature control valve is accidentally fixed, the pump water temperature can no longer follow the target water temperature. In this instance, a control water temperature error between the target water temperature and the pump water temperature is calculated. When the control water temperature error is greater than a certain error range, a counter is incremented, and a malfunction judgment flag is set when the value of the counter exceeds a certain judgment threshold value at another time. Thereby, the temperature of the cooling water for the engine is feedback controlled while malfunction of the water temperature control valve can be accurately detected.

7 Claims, 8 Drawing Sheets

FIG. 6

| PUMP | | CHANGE AMOUNT OF VALVE OPENING DEGREE | | | | | | |
|---|---|---|---|---|---|---|---|---|
| | | +χ%·····CURRENT POSITION·····−χ% | | | | | | |
| DUTY | 10 | 3 | 2 | 1 | 0 | −1 | −2 | −3 |
| | 20 | 4 | | | | | | |
| | ⋮ | | | | | | | |
| | 90 | 6 | | | | | | |
| | 100 | 6.2 | | | | | | |

FIG. 7

| BLOWER | | CHANGE AMOUNT OF VALVE OPENING DEGREE | | | | | | |
|---|---|---|---|---|---|---|---|---|
| | | +χ%·····CURRENT POSITION·····−χ% | | | | | | |
| DUTY | 10 | 3 | 2 | 1 | 0 | −1 | −2 | −3 |
| | 20 | 4 | | | | | | |
| | ⋮ | | | | | | | |
| | 90 | 6 | | | | | | |
| | 100 | 6.2 | | | | | | |

MALFUNCTION DETECTING APPARATUS FOR WATER TEMPERATURE CONTROL VALVE

CROSS REFERENCE TO RELATED APPLICATION

This application is based upon, claims the benefit of priority of, and incorporates by reference the contents of prior Japanese Patent Application No. 2002-72478 filed Mar. 15, 2002.

BACKGROUND OF THE INVENTION

1. Field of the Invention

The present invention relates to malfunction detection of a water temperature control valve on a water-cooled engine.

2. Description of the Related Art

It is necessary for a water-cooled engine to control its water temperature within an appropriate temperature range in order to run the engine efficiently. Improving the engine's efficiency is usually accomplished by improving the intake-air filling efficiency and by suppressing increases in friction loss at an operating portion within the engine. To this end, the inventors of the present invention filed a patent application (disclosed as Japanese Unexamined Patent Publication N. 2000-45773) relating to a technique to control engine cooling water temperature within an appropriate temperature range. According to this technique, with the aim of making an actual cooling water temperature follow the target value of the cooling water temperature, a ratio of the flow rate of cooling water from the radiator passage side to the flow rate of cooling water from the bypass passage side is adjusted. The publication discloses a technique to control cooling water temperature to match the target water temperature through this adjustment achieved by feedback controlling an opening degree of a rotary valve.

Recently, vehicle emission control has been enforced in Japan, the European Union, and the United States, and detection of abnormalities in emission-reducing engine components is mandatory. However, as for the technique of using feedback control to control the actual cooling water temperature so that it maintains the target value of the cooling water temperature, a malfunction detecting method for a water temperature control valve has not been established.

SUMMARY OF THE INVENTION

It is therefore an object of the present invention to enable malfunction detection of the water temperature control valve used during feedback control of the engine cooling water temperature.

In order to achieve the above and other objects, according to a first aspect of the invention, malfunction of the water temperature control valve is detected based on a cooling water temperature target value and a value of the cooling water temperature while a cooling water temperature control means is controlling the water temperature control valve.

Under such control that makes the cooling water temperature follow the target value, the detected value of the cooling water temperature follows the target value when the water temperature control valve is operating normally. In contrast, in a case where the water temperature control valve is fixed accidentally, for example, the detected value of the cooling water temperature deviates from the target value. It is thus possible to accurately detect a malfunction of the water temperature control valve based on a relationship between the target value and the detected value of the cooling water temperature. Herein, the relation between the target value and the detected value of the cooling water temperature shows that a deviation of the detected value of the cooling water temperature from the target value of the cooling water temperature becomes greater in the event of a malfunction.

According to a second aspect of the invention, a malfunction detecting means is able to accurately detect malfunction of the water temperature control valve based on the deviation of the detected value of the cooling water temperature from the target value of the cooling water temperature.

According to a third aspect of the invention, the malfunction detecting means detects malfunction of the water temperature control valve when the deviation of the value of the cooling water temperature detected by a cooling water temperature detecting means from the target value of the cooling water temperature set by target temperature setting means exceeds a certain threshold value for at least a certain time period.

Because malfunction of the water temperature control valve is judged only when the deviation exceeds the certain judgment threshold value continuously for at least the certain period, it is possible to reduce erroneous judgment due to hunting or the like while the cooling water temperature is controlled.

When the vehicle is running at a high speed or under high-load operating conditions, particular inconveniences may occur. Firstly, when the vehicle is running at a high speed, heat radiation from the radiator passages increase because the air passing through them is increased. Hence, control such that makes the cooling water temperature follow the target value may possibly cause hunting. Secondly, under the high-load operating state, the heat generation amount of the engine increases, and the difference from the target value of the cooling water temperature increases. Hence, hunting may possibly occur when making the cooling water temperature follow the target value of the cooling water temperature. By taking these circumstances into account, in the case of making judgment based on only a deviation of the detected value of the cooling water temperature from the target value of the cooling water temperature, there is a possibility that normal operation of the water temperature control valve may be erroneously judged as abnormal depending on the operating state.

Hence, according to a fourth aspect of the invention, the certain judgment threshold value used to judge a malfunction may preferably be variably set based on the operating state of an internal combustion engine. Consequently, even when response of the water temperature control is changed according to the operating state, erroneous judgment can be reduced by changing the judgment threshold value depending on the operating state.

According to a fifth aspect of the invention, the cooling water temperature detecting means includes a sensor provided to a cooling water passage of the internal combustion engine for outputting the cooling water temperature, and thereby detects the temperature output from the sensor. Also, the cooling water temperature control means adjusts the water temperature control valve in such a manner that the cooling water temperature detected by the cooling water temperature detecting means follows the target value of the cooling water temperature set by the target temperature setting means.

Further, according to a sixth aspect of the invention, the sensor for outputting the cooling water temperature is provided somewhere along a passage from a junction of the radiator passage and a bypass passage to the internal combustion engine.

It is thus possible to accurately control the cooling water temperature which circulates through the internal combustion engine. Hence, not only can filling efficiency of intake air be improved, but also an increase in frictional losses at an operating portion, that is, at the contact portions of moving parts, within the internal combustion engine can be reduced.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 6 is a control map for the pump;

FIG. 7 is a control map for a blower;

DETAILED DESCRIPTION OF THE PREFERRED EMBODIMENTS

The following description is merely exemplary in nature and is in no way intended to limit the invention, its application, or uses.

Figure 1:
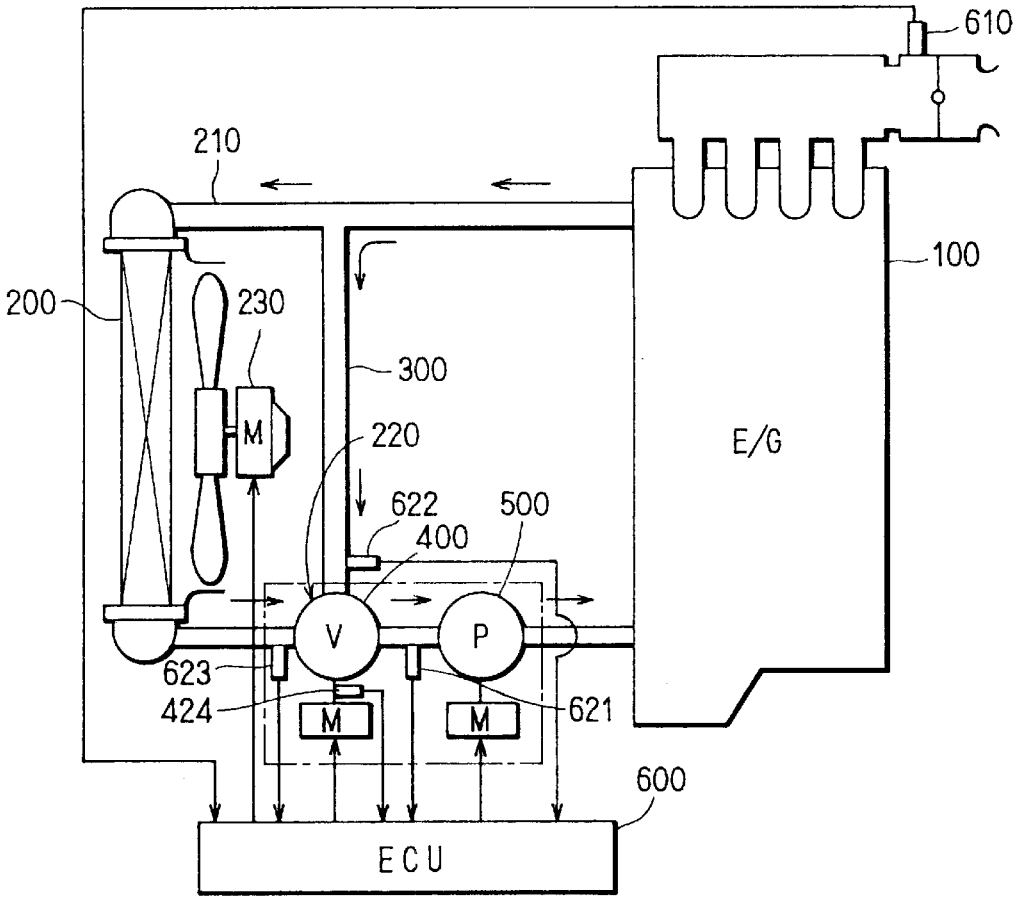
FIG. 1 is a schematic view showing an overall arrangement according to a first embodiment of the invention.

In one embodiment there is a cooling apparatus for a liquid-cooled internal combustion engine according to the invention that is applied to a water-cooled engine (water-cooled internal combustion engine) for driving a vehicle. FIG. 1 is a schematic view showing an arrangement of the cooling apparatus of this embodiment.

Referring to FIG. 1, a radiator 200 cools cooling water or any coolant that circulates in a water-cooled internal combustion engine (hereinafter, engine) 100. Radiator channel 210 circulates the cooling water to the radiator 200. A bypass channel 300 introduces the cooling water that flows from the engine 100 to the outlet side of the radiator 200 by bypassing the radiator 200.

A rotary flow rate control valve (hereinafter, referred to simply as the control valve) 400 is provided at a junction 220 between the bypass channel 300 and the radiator channel 210 to control a ratio of a flow rate of the cooling water passing through the radiator channel 210 (hereinafter, referred to as the radiator flow rate Vr) to a flow rate of the cooling water passing through the bypass channel 300 (hereinafter, referred to as the bypass flow rate Vb). An electric pump (hereinafter, referred to simply as the pump) 500 for circulating the cooling water, which is operated independently of the engine 100, is provided at a downstream side (engine 100 side) of the flow control valve 400 with respect to the cooling water flow direction.

Figure 2A:
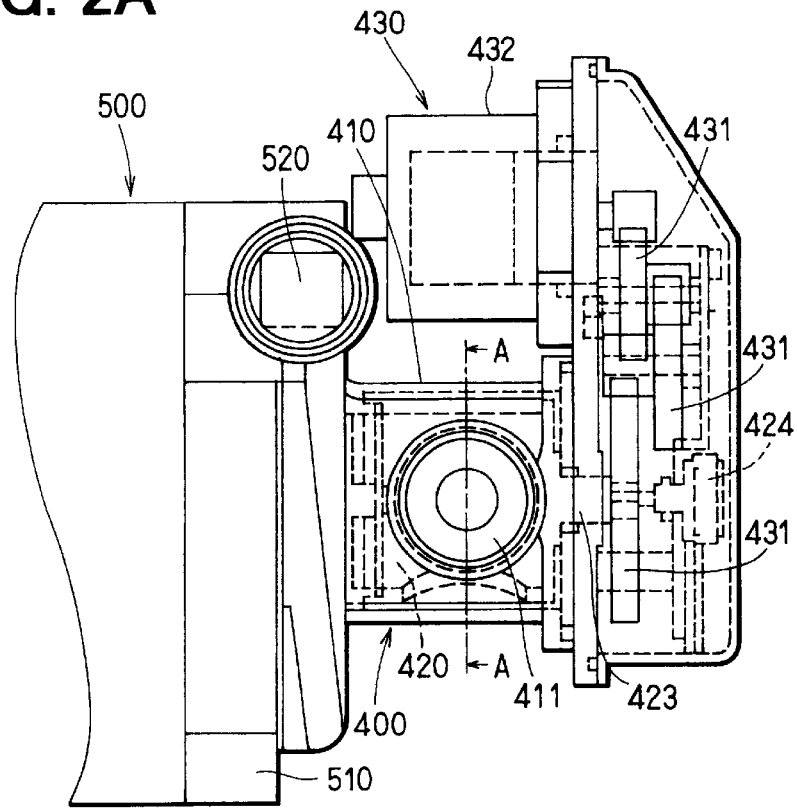
FIG. 2A is an outside view showing integration of a control valve and a pump according to the first embodiment of the invention.
Figure 2B:
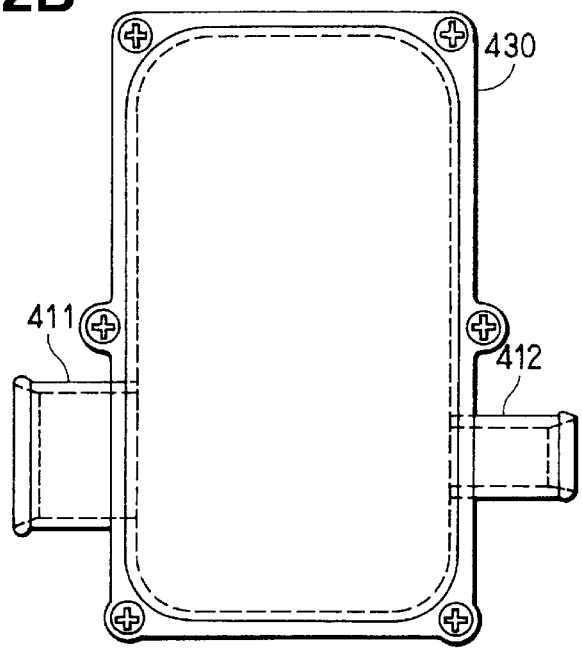
FIG. 2B is an outside view showing integration of a control valve and a pump according to the first embodiment of the invention.

A structure of the control valve 400 will now be described briefly. As shown in FIG. 2A and FIG. 2B, the flow control valve 400 and the pump 500 are integrated together via a pump housing 510 and a valve housing 410. The valve housing 410 and the pump housing 510 are both made of resin. As shown in FIG. 2A through FIG. 3B, a cylindrically-shaped rotary valve (hereinafter, referred to simply as the valve) 420 having one end in the longitudinal direction (axial direction) being closed (shaped like a cup) is rotatably housed in the valve housing 410. The valve 420 is rotated around the cylindrical shaft by a step motor 430 having a servo motor (driving means) 432 and a speed reducing device comprising several gears 431 as shown in FIG. 2A.

The step motor 430 is formed into a cylindrical shape, and is composed of an outside portion and an inside portion (not shown). The outside portion is provided with a plurality of separate magnetic coils on the inner side of the cylinder along the rotational direction with respect to the central axis. The inside portion is formed into a cylindrical shape that conforms to the interior of the outside portion, and N-pole and S-pole magnets are aligned at regular intervals along the central axis. According to this arrangement, a rotational angle position of the inside portion can be changed step-wise by, for example, flowing a current through the magnetic coils so that the magnets of the pole corresponding to the current-passing direction of the coils are attracted, and then by flowing a current through the magnetic coils in the opposite direction so that the adjacent magnets of the opposite pole are attracted. Hence, in this embodiment, the rotational angle position of the valve 420 is controlled by switching the step motor 430 ON and OFF. In practical applications, however, because the step motor 430 produces only a small driving torque, the valve 420 is rotated through the gears 431.

Figure 3A:
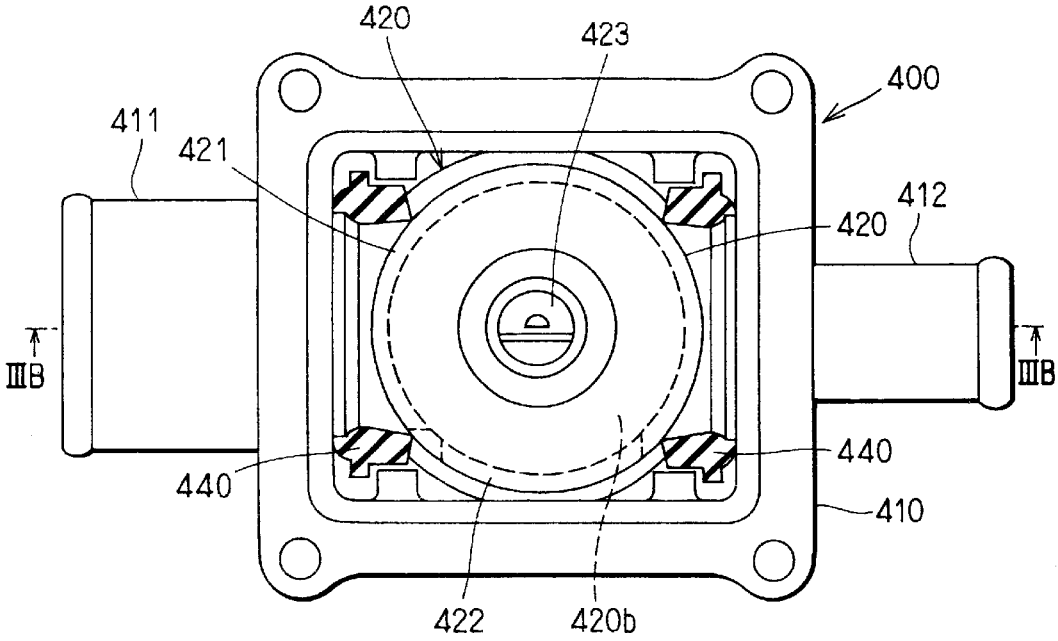
FIG. 3A is a cross-sectional view taken along line A—A of FIG. 2A.
Figure 3B:
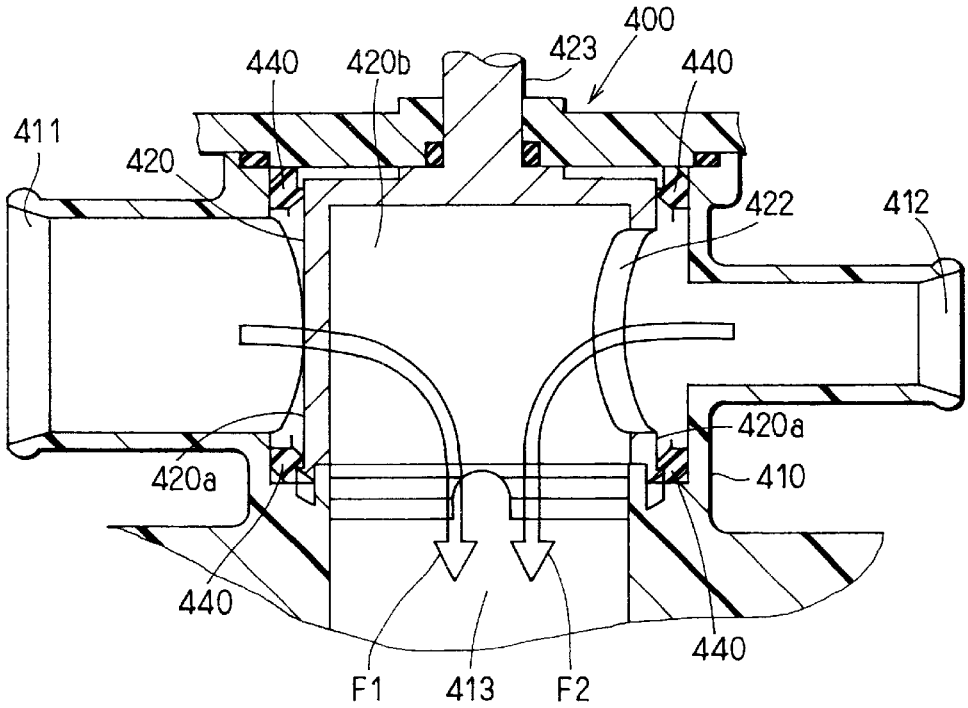
FIG. 3B is a cross-sectional view taken along line IIIB—IIIB of FIG. 3A.

As shown in FIG. 3A and FIG. 3B, a first valve port 421 and a second valve port 422 of congruent, or equal, shape (in this embodiment, circles having substantially the same diameter) are formed on the cylindrical side surface 420*a* of the valve 420 for communicating the inside and the outside of the cylindrical side surface 420*a*. The valve ports 421 and 422 deviate from the cylindrical shaft of the valve 420 by about 90°. On the other hand, as shown in FIG. 3A and FIG. 3B, a radiator port (radiator side inlet) 411 communicating with the radiator channel 210 and a bypass port (bypass side inlet) 412 communicating with the bypass channel 300 are formed on a part of the valve housing 410 which corresponds to the cylindrical side surface 420*a* of the valve 420.

Figure 4:
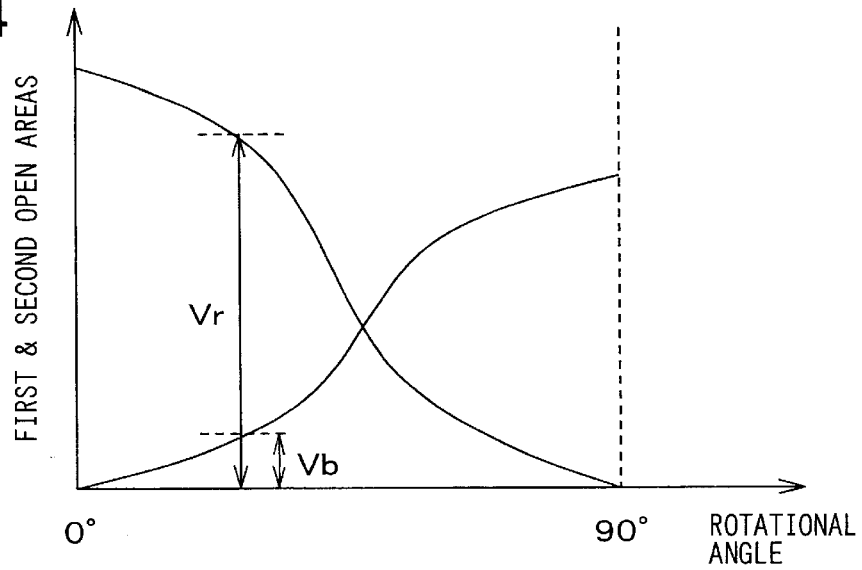
FIG. 4 is a graph showing an opening degree characteristic of the control valve according to the first embodiment of the invention.

Hence, by rotating the valve 420 of the control valve 400, it is possible to adjust a ratio of the flow rate of the cooling water passing through the radiator port 411 to the flow rate the cooling water passing through the bypass port 412 of the valve housing 410. The corresponding flows are represented by arrows, F1 and F2, respectively. Adjustment of the flow rate ratio through rotations of the valve 420 will further be explained with reference to FIG. 4. FIG. 4 shows an open area defined by the first valve port 421 formed in the valve 420 and the radiator port 411 in association with rotations of the valve 420 (hereinafter, referred to as the first open area). Additionally, an open area is defined by the second valve port 422 formed in the valve 420 and the bypass port 412 (hereinafter, referred to as the second open area).

FIG. 3A shows a state when the first valve port 421 of the valve 420 and the radiator port 411 coincide 100 percent, while the second valve port 422 of the valve 420 and the bypass port 412 do not coincide at all. Given this point as the reference position of the rotational angle of the valve 420 in FIG. 4, then the first open area decreases while the second open area increases in association with rotations of the valve 420. By setting the rotational angle of the valve 420 to 90°, the second valve port 422 of the valve 420 and the bypass port 412 coincide 100 percent while the first valve port 421 of the valve 420 and the radiator port 411 do not coincide at all. Because a total flow rate of the cooling water flown into the radiator port 411 and the bypass port 412 is adjusted by operation of the pump 500, the flow rate ratio of the radiator port 411 to the bypass port 412 can be adjusted by controlling rotations of the valve 420.

Further, a pump port (outlet) 413 for communicating the cylindrical inner portion 420*b* of the valve 420 with the suction side of the pump 500 is formed on a part of the valve housing 410 which corresponds to the other end of the valve 420 in the axial direction of the cylindrical shaft. Packing 440 seals a gap between the cylindrical side surface 420*a* of the valve 420 and the inner wall of the valve housing 410 to prevent the cooling water, which has flown into the valve housing 410 through the radiator port 411 and the bypass port 412, from passing through the pump port 413 by bypassing the cylindrical inner portion 420*b* of the valve 420. Also, as shown in FIG. 2A, a potentiometer 424, as an opening degree detecting means, for detecting a rotational angle of the valve 420 (valve opening degree of the control valve 400) is provided to a rotary shaft 423 of the valve 420, and detected signals at the potentiometer 424 are input to an ECU 600 described below.

An electronic control unit (ECU) 600 controls the control valve 400 and the pump 500. Detected signals from a pressure sensor 610 for detecting an intake negative pressure of the engine 100, first through third water temperature sensors 621, 622, and 623 for detecting a cooling water temperature, and a speed sensor 624 for detecting an engine speed of the engine 100 are inputted to the ECU 600. The ECU 600 controls the control valve 400, the pump 500, and a blower 230 based on these detected signals.

The first water temperature sensor 621 detects a cooling water temperature flowing into the pump 500 (engine 100) at a side of the pump port 413 (hereinafter, referred to as the pump water temperature Tp). The second water temperature sensor 622 detects a cooling water temperature passing through the bypass channel 300 at a side of the bypass port 412, that is, a cooling water temperature flowing out from the engine 100 (hereinafter, referred to as the bypass water temperature Tb). The third water temperature sensor 623 detects a cooling water temperature flowing out from the radiator 200 at a side of the radiator port 411 (hereinafter, referred to as the radiator water temperature Tr). Also, an external air temperature sensor (not shown) detects an external air temperature of the vehicle.

An operation according to this embodiment will now be described with reference to the flowchart shown in FIG. 5. The flowchart shows a processing routine to control the temperature Tp of the pump water so that it matches the temperature Tmap of the target water and becomes the temperature of the cooling water which circulates in the engine 100. The routine is executed every 32 msec. while the engine is running. Initially, in Step S100, the ECU 600 computes an engine speed NE of the engine 100 from a signal output from the crankshaft, and reads out an intake-air pressure PM detected by an intake-air pressure sensor from a RAM (not shown). Then, the ECU 600 finds an intake-air amount GA to be supplied to the respective cylinders (not shown) of the engine 100 based on the engine speed NE and the intake-air pressure PM using a map pre-stored in the ECU 600. Also, the ECU 600 reads out the external water temperatures Tp, Tb, and Tr detected respectively at the sensors 621, 622, and 623, and the external air temperature Tha of the vehicle detected at the external air temperature sensor in Step S100.

The ECU 600 proceeds to Step S101 when it ends the processing in Step S100, and determines a basic flow rate of the cooling water which circulates in the engine 100 (rotation speed of the pump 500) and a target cooling water temperature which flows in the engine 100 (hereinafter, referred to as the target water temperature Tmap) based on the intake-air amount GA computed in Step S100 from a map (not shown). Also, the ECU 600 determines a basic flow rate of the cooling water to be circulated to the engine 100 based on the intake-air amount GA from a map (not shown).

The map used to set the target water temperature Tmap is created in such a manner that the water temperature under a smaller engine load (intake-air amount GA) becomes higher than the water temperature under a greater engine load (intake-air amount GA). This is because knocking occurs more frequently under the greater engine load, and knocking occurs less frequently under the smaller engine load.

Then, in Step S102, the ECU 600 judges whether the pump water temperature Tp is within a certain range with reference to the target water temperature Tmap (in this embodiment, $\pm\alpha°$ C.=±2° C.). When the pump water temperature Tp is within the certain range with reference to the target water temperature Tmap, the ECU 600 judges positive (YES) in Step S102, and proceeds to Step S103. In Step S103, the ECU 600 maintains the current rotational angle of the control valve 400, and returns to Step S100 to repeat the processing described above.

On the other hand, when the pump water temperature Tp is outside of the certain range with reference to the target water temperature Tmap, the ECU 600 judges negative (NO) in Step S102, and proceeds to Step S104. In Step S104, the ECU 600 determines the valve opening degree amount to be changed from the current valve opening degree, the flow rate of the cooling water to be changed from the current cooling water flow rate (basic cooling water flow rate), and the blown air amount to be changed from the current blown air amount based on the difference between the target water temperature Tmap and the pump water temperature Tp, ($\Delta T$=Tmap−Tp), according to maps shown in FIGS. 6 and 7. In this instance, the ECU 600 determines the valve opening degree, the cooling water flowing rate, and the blown air amount in such a manner that the electric power consumption of the pump 500 and the blower 230 is minimized.

The map of FIG. 6 shows that the rotational speed of the pump 500 increases as the duty of the pump 500 increases. The map of FIG. 7 shows that the rotational speed of the blower 230 increases as the duty of the blower 230 increases. Both duties are determined based on the engine load in such a manner that, as described above, electric power consumption of the pump 500 and the blower 230 is minimized.

In Step S105, the ECU 600 outputs control signals to the respective actuators, so that the control valve 400, the pump 500, and the blower 230 are brought into operational conditions in agreement with their respective, determined values. By repeating the control processing from Step S100 through Step S105, it is possible to employ feedback control for the control valve 400 to make the pump water temperature Tp follow the target water temperature Tmap. A characteristic of this embodiment will now be described.

Because the pump water temperature Tp is determined by the mixture of the cooling water passing through the bypass channel 300 and the cooling water passing through the radiator 200, detection of the radiator flow rate Vr and the bypass flow rate Vb is necessary as well as detection of the radiator water temperature Tr and the bypass water temperature Tb in order to control the pump water temperature Tp to accurately match the target water temperature Tmap.

However, as described above, it is practically difficult to accurately measure the flow rate of the cooling water which circulates in the cooling apparatus. Hence, according to this embodiment, the radiator flow rate Vr and the bypass flow rate Vb, that is, the valve opening degree, are determined based on the pump water temperature Tp, the radiator water temperature Tr, and the bypass water temperature Tb as described as follows. As described above, because the pump water temperature Tp is determined by the mixture of the cooling water passing through the bypass channel 300 and the cooling water passing through the radiator 200, the pump water temperature Tp is represented by equation 1.

$$Tp=(Tr\cdot Vr+Tb\cdot Vb)/(Vr+Vb) \quad \text{[Equation 1]}$$

The flow rate ratio Vrb of the radiator flow rate Vr to the bypass flow rate Vb is defined by the following equation 2.

$$Vrb=Vr/Vb \quad \text{[Equation 2]}$$

Accordingly, equation 1 is converted to equation 3.

$$Tp=(Tb+Tr\cdot Vrb)/(1+Vrb) \quad \text{[Equation 3]}$$

Further, equation 3 is converted to equation 4.

$$Vrb=(Tb-Tp)/(Tp-Tr) \quad \text{[Equation 4]}$$

Figure 8:
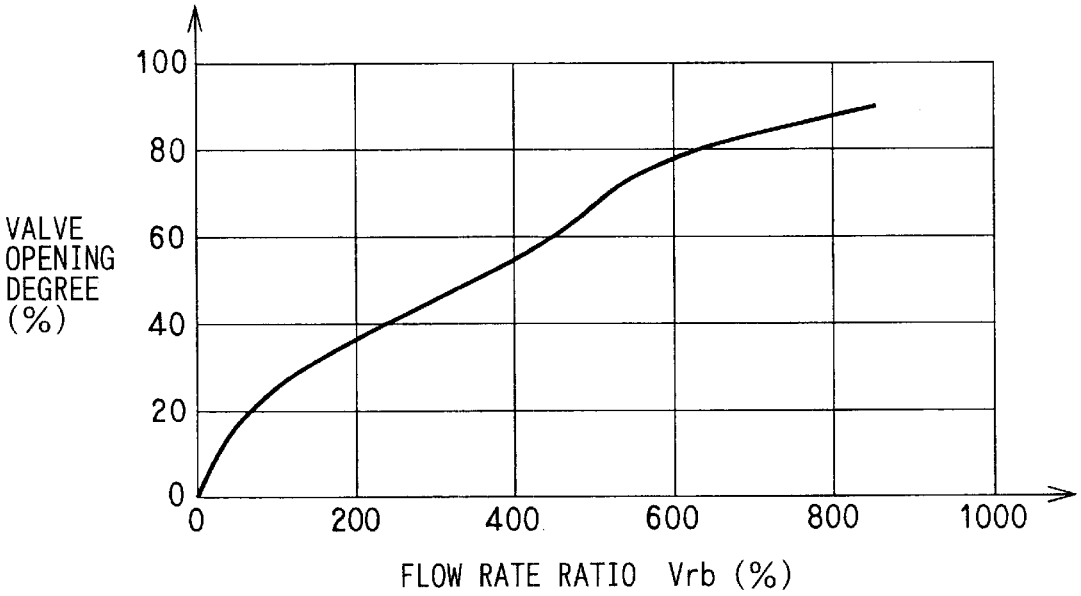
FIG. 8 is a graph showing a characteristic of a valve opening degree versus a flow rate ratio.

The valve opening degree is determined as a function of the flow rate ratio Vrb as shown in FIG. 8. Thus, the valve opening degree is determined univocally by finding the flow rate ratio Vrb. Additionally, the relation between the flow rate ratio Vrb and the valve opening degree shown in FIG. 8 is derived from experimental data.

It is apparent from equation 4 that the flow rate ratio Vrb is calculated from the pump water temperature Tp, the radiator water temperature Tr, and the bypass water temperature Tb. If the pump water temperature Tp in equation 4 is substituted by the target water temperature Tmap in calculating a target flow rate ratio Vrb, the target flow rate ratio Vrb is determined by equation 5 as follows. The flow rate ratio Vrb determined by equation 4 is hereinafter referred to as the actual flow rate ratio Vrb.

$$Vrb=(Tb-Tmap)/(Tmap-Tr) \quad \text{[Equation 5]}$$

Accordingly, the valve opening degree amount to be changed from the current valve opening degree, that is, the map shown in FIG. 6, is determined from a difference between the target valve opening degree determined from the target flow rate ratio Vrb and FIG. 8 and the actual valve opening degree determined from the actual flow rate ratio Vrb and FIG. 8.

As has been described above, according to this embodiment, the valve opening degree is determined accurately from the pump water temperature Tp, the radiator water temperature Tr, and the bypass water temperature Tb without measuring the actual cooling water flow rate. Although the pump water temperature Tp is determined according to only the conditions of the cooling water passing through the bypass channel 300 and the cooling water passing through the radiator 200, there are, actually, time lags among the water temperature detection at the first through third water temperature sensors 621, 622, and 623. Therefore, the time lags may give rise to a difference between the actual temperature and the detected cooling water temperature. Thus, it is desirable to place the first through third water temperature sensors 621, 622, and 623 as close as possible when the first through third water temperature sensors 621, 622, and 623 are installed. Alternatively, a correction may be performed in response to the time lags.

When the engine load increases and the target water temperature Tmap decreases, as described above, the valve opening degree is changed and the radiator flow rate Vr thereby increases. However, when the radiator flow rate Vr increases, circulation speed of the cooling water increases. Hence, when attention is paid to a particular part of the cooling water, the time needed for that particular part of the cooling water to pass through the radiator 200 is shortened. In other words, heat radiation performance of the cooling water decreases as the radiator flow rate Vr increases.

Hence, when the radiator flow rate Vr is increased in order to reduce the pump water temperature Tp, the heat radiation performance decreases for the increased amount of the radiator flow rate Vr. Accordingly, the ratio of the cooling performance to the pump work of the pump 500 (the electric power consumption of the pump 500) necessary for circulating the cooling water to the radiator 200 is reduced, and unnecessary pump work increases.

According to this embodiment, however, the blown air amount of the blower 230 is also controlled based on the engine load. Thus, the heat radiation performance of the radiator 200 is increased when the blow air amount is increased according to the increase of the engine load. Accordingly, increase of unnecessary pump work is prevented.

As has been explained above, this embodiment feedback controls the temperature of cooling water which circulates in the engine 100 through adjustment of the valve opening degree. Under current US regulations, user notification is mandatory as to any malfunction of the emission-related engine components if such malfunction causes emissions exceeding the emission control value. Hence, it will become possible in the near future to detect malfunctions not only in the United States, but in Japan and the European union when the valve 420 that controls the cooling water temperature is actually installed in vehicles. Thus, the processing to judge malfunction of the valve 420 in the above arrangement will now be explained in detail with reference to the flowchart of FIG. 9.

Figure 5:
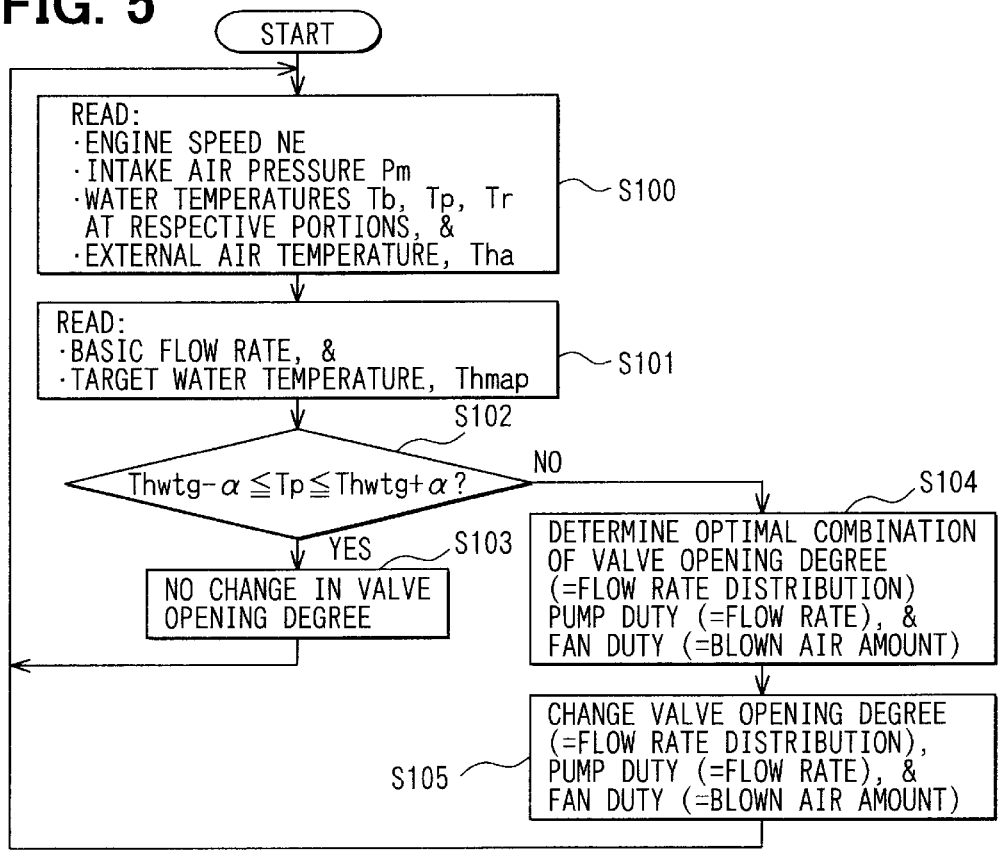
FIG. 5 is a flowchart detailing cooling water temperature control according to the first embodiment of the invention.
Figure 9:
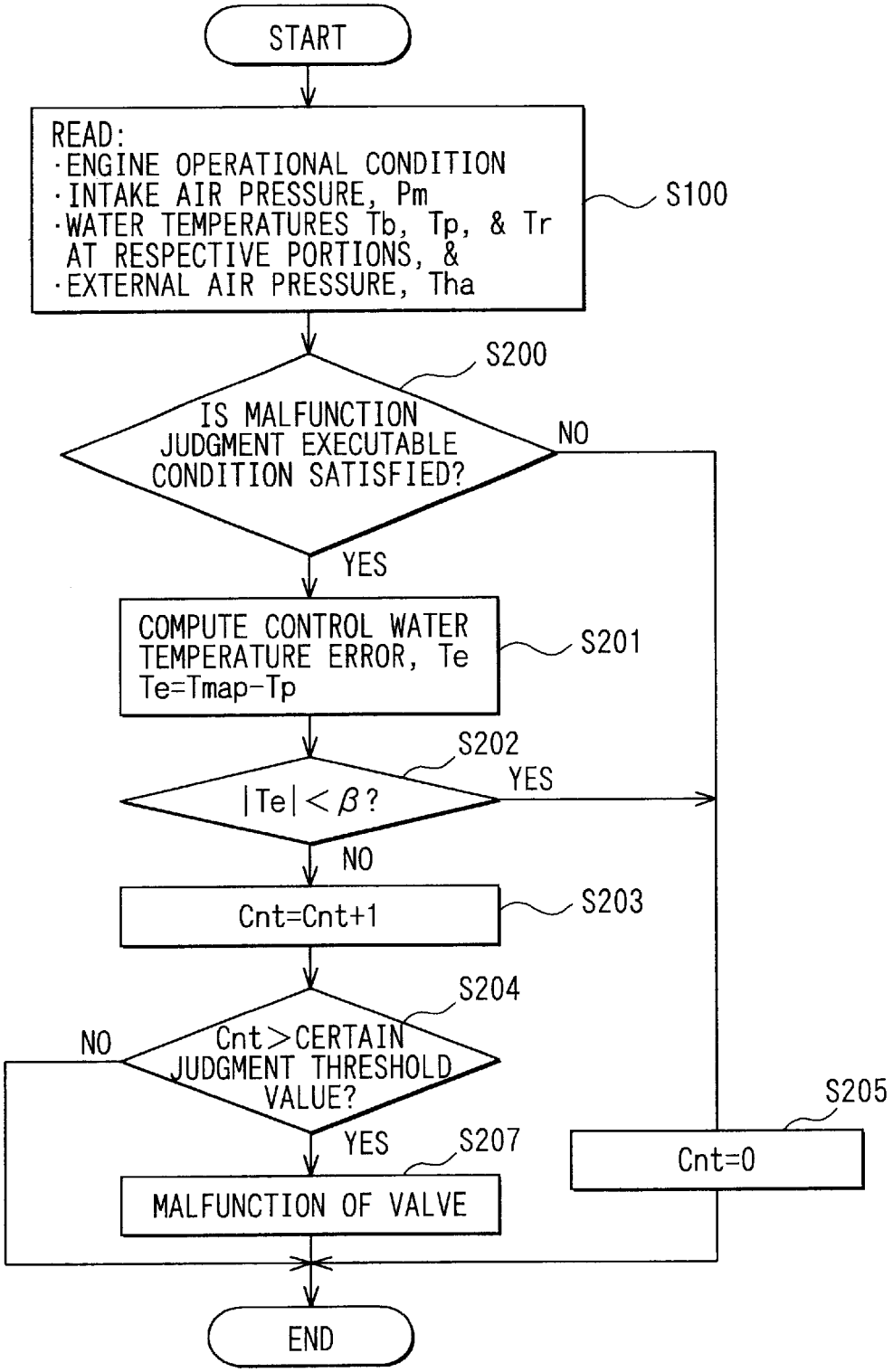
FIG. 9 is a flowchart detailing a malfunction judgment according to the first embodiment of the invention.

In FIG. 9, step S100 is the same as the processing in Step S100 of the flowchart of FIG. 5, therefore explanations pertaining to Step S100 are omitted in this instance. After S100, the ECU 600 judges a malfunction judgment executable condition in Step S200. The malfunction judgment executable condition is, for example, whether the operating state of the engine 100 is experiencing normal operation. When the malfunction judgment executable condition is not satisfied based on the operating state, the ECU 600 judges negatively in Step S200 (NO), and ends the routine without executing any further processing. On the other hand, when the malfunction judgment executable condition is satisfied, the ECU 600 judges positively (YES) in Step S200 and executes the processing in Step S201 and proceeds.

Figure 10:
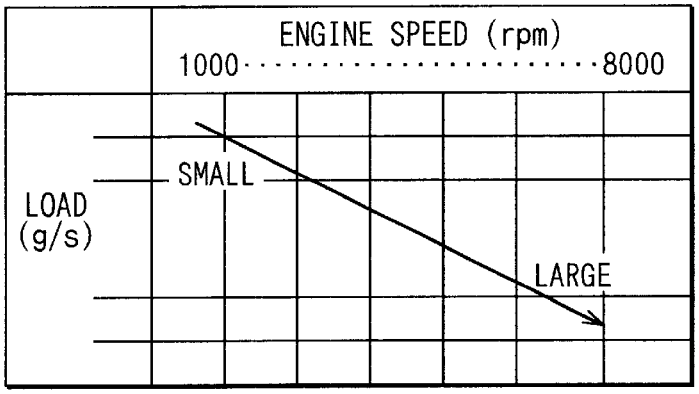
FIG. 10 is a map used to set an operating state error range which is referred to when judging a control water temperature error in the first embodiment of the invention.

In Step S201, the ECU 600 calculates a control water temperature error Te (Te=Tmap−Tp). The control water temperature error Te is a deviation, of the pump water temperature Tp detected at the first water temperature sensor 621, from the target water temperature Tmap. In Step S202, the ECU 600 judges whether the control water temperature error Te is within a certain error range (in this embodiment, an initial error range is ±β° C.). The error range β may be set according to the operating region. A map shown in FIG. 10 is a map used to set the error range β according to the engine speed NE and the intake-air amount GA. More specifically, because a heat radiation amount from the radiator 200 increases when the engine speed NE is high, heat generation from the engine 100 increases when the intake-air amount GA is large. Thus, it is difficult to control the actual cooling water temperature T to accurately match the target cooling water temperature Tmap. Hence, in view of the foregoing, it is preferable to set the error range β according to the map so that the map is divided into respective operating states.

In Step S202, the ECU 600 judges positive (YES) when the control water temperature error Te is within the error range β, and proceeds to Step S205 to reset a counter Cnt described below, after which the ECU 600 ends the routine. On the other hand, the ECU 600 proceeds to Step S203 when the control water temperature error Te is outside of the error range β.

In Step S203, the ECU 600 increments the counter Cnt and proceeds to subsequent Step S204. The counter Cnt is a counter that counts a period during which the control water temperature error Te exceeds the error range β. In Step S204, the ECU 600 judges whether the counter Cnt has counted a certain judgment threshold value. When the counter Cnt has not counted the certain judgment threshold value, the ECU 600 judges negative (NO) in Step S204, and ends the routine. On the other hand, when the counter Cnt has counted a value greater than the certain judgment threshold value, the ECU 600 judges positive (YES) in Step S204, and proceeds to Step S207. In Step S207, the ECU 600 judges malfunction of the valve 420 and ends the routine.

As has been described, in this embodiment, the temperature of the cooling water that circulates through the cooling water passage to cool the engine 100 depending on the operating state is feedback controlled. This control makes it possible to accurately judge malfunction of the valve 420 based on deviation of the pump water temperature Tp from the target water temperature Tmap.

In a case where the driving of the valve 420 is controlled by a DC motor or the like, in general, an amount of current flown to the motor is specified through detection of the position of the valve 420. Hence, when a malfunction occurs in the DC motor, a specified value of the driving quantity may be fixed to the maximum output. Accordingly, a malfunction can be detected by monitoring the behavior of the specified value. In contrast, because the step motor 430 is not generally provided with a sensor for detecting the position of the valve 420, it sets the position of the valve 420 based on the number of switching-ON times. Hence, only the number of switching-ON times is available for judgment of a malfunction occurring in the motor, which makes it difficult to detect a malfunction of the step motor 430.

According to this embodiment, however, even when a malfunction occurs in the step motor 430, it is still possible to detect the malfunction from the behavior of the cooling water temperature. In this embodiment, a DC motor may be used instead of the step motor 430.

Figure 11A:
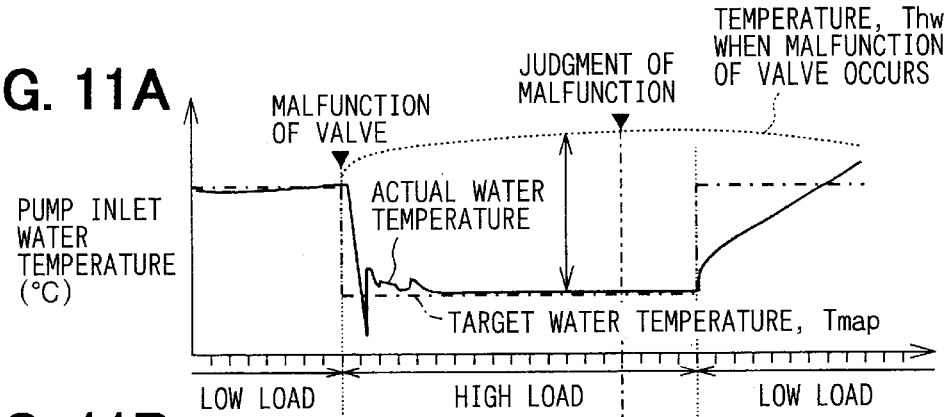
FIG. 11A through FIG. 11E are time charts showing one example to which the embodiment of the invention is applied.
Figure 11B:
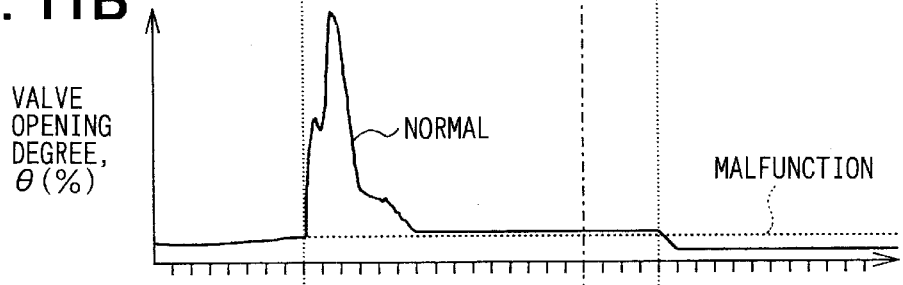
Figure 11C:
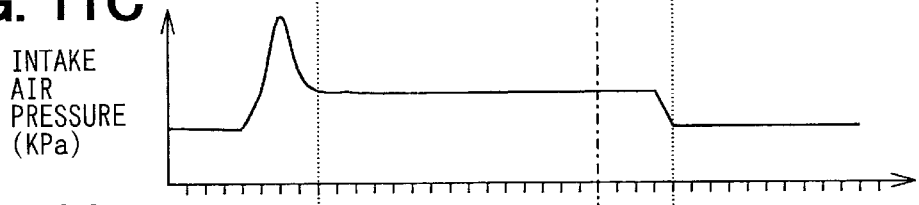

An example to which this embodiment is applied will now be explained in detail with reference to time charts shown in FIGS. 11A through 11E. FIG. 11A shows the cooling water temperature Tp at the inlet of the pump, and a value indicated by an alternate long and short dash line is the target water temperature Tmap. The target water temperature Tmap is set to a high temperature when the intake-air pressure PM as the engine load is small, and to a low temperature when the intake-air pressure PM as the engine load is large. When the intake-air pressure PM increases at a time T1 as shown in FIG. 11C, the target water temperature Tmap is set to a low temperature. Then, in this embodiment, the rotational angle of the valve 420 is controlled as shown in FIG. 11B, so that the pump water temperature Tp follows the target water temperature Tmap.

Figure 11D:
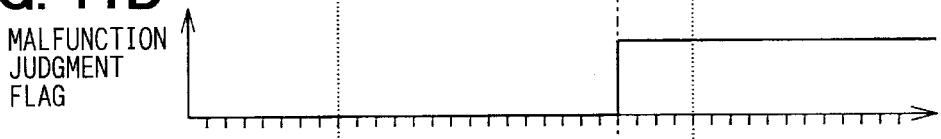
Figure 11E:
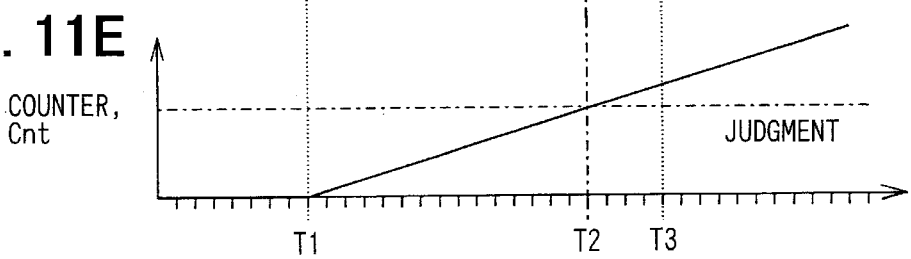

In a case in which no malfunction occurs in the valve 420, the pump water temperature Tp is controlled to accurately follow the target water temperature Tmap. A case in which the valve 420 is accidentally fixed, that is, stuck, will now be explained. When the rotational opening degree θ of the valve 420 is accidentally fixed at time T1 as indicated by the dotted line of FIG. 11B, the pump water temperature Tp can no longer follow the target water temperature Tmap as indicated by the dotted line of FIG. 11A. In this instance, the control water temperature error Te is calculated as a deviation of the pump water temperature Tp from the target water temperature Tmap. Then, when the control water temperature error Te is greater than a certain error range, the counter Cnt is incremented as shown in FIG. 11E, and as shown in FIG. 11D, a malfunction judgment flag is set when the value of the counter Cnt exceeds the certain judgment threshold value at a time T2.

As has been described above, according to this embodiment, the temperature of the cooling water, which circulates through the cooling water passage to cool the engine 100 depending on the operating state, is feedback controlled. This control makes it possible to accurately judge a malfunction of the valve 420 based on a deviation of the pump water temperature Tp from the target water temperature Tmap.

In this embodiment, the cooling water temperature is detected at three water temperature sensors. It goes without saying that the invention can be of an arrangement in which the number of water temperature sensors is reduced to the smallest number that can achieve water temperature control.

In this embodiment, the cooling water temperature detecting means corresponds to the first water temperature sensor 621. The target water temperature setting means corresponds to Step S101 in the flowchart of FIG. 5. The cooling water temperature control means corresponds to Step S102 through Step S105 in the flowchart of FIG. 5. Finally, the malfunction detecting means corresponds to the flowchart of FIG. 9, and the operating state detecting means to Step S100 of FIG. 5 and FIG. 9, and each functions as such.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A malfunction detecting apparatus for a water temperature control valve comprising:

a tube defining a radiator channel wherein the radiator channel is provided to circulate cooling water, which is flown from a water-cooled internal combustion engine cooled by a radiator and returned from said radiator to said internal combustion engine;

a tube defining a bypass passage wherein the bypass channel circulates the cooling water flown out from said internal combustion engine to an outlet side of said radiator by bypassing said radiator;

a water temperature control valve for adjusting a ratio of a flow rate of the cooling water passing through said radiator passage to a flow rate of the cooling water passing through said bypass passage means for detecting a temperature of said cooling water;

means for setting a target temperature of the temperature of said cooling water;

means for controlling said cooling water temperature by setting an opening degree of said water temperature control valve based on a target value of the temperature of said cooling water set by said target temperature setting means and a value of the temperature of said cooling water detected by said cooling water temperature detecting means and means for detecting malfunction of said water temperature control valve based on the target value of the temperature of said cooling water set by said target temperature setting means and the temperature of said cooling water detected by said cooling water temperature detecting means during controlling of said cooling water temperature control valve by said cooling water temperature control means.

2. The malfunction detecting apparatus for a water temperature control valve according to claim 1, wherein said malfunction detecting means detects malfunction of said water temperature control valve based on a deviation of the value of the temperature of said cooling water detected by said cooling water temperature detecting means from the target value of the temperature of said cooling water set by said target temperature setting means.

3. The malfunction detecting apparatus for a water temperature control valve according to claim 1, wherein said malfunction detecting means detects malfunction of said water temperature control valve when a deviation of the value of the temperature of said cooling water detected by said cooling water temperature detecting means from the target value of the temperature of said cooling water set by said target temperature setting means exceeds a certain judgment threshold value for at least a certain time period.

4. The malfunction detecting apparatus for a water temperature control valve according to claim 3, further comprising:

means for detecting an operating state of said internal combustion engine wherein said certain judgment threshold value is set variably based on the operating state of said internal combustion engine detected by said operating state detecting means.

5. The malfunction detecting apparatus for a water temperature control valve according to claim 4, wherein:

said cooling water temperature detecting means includes a sensor provided to a cooling water passage of said internal combustion engine for outputting the temperature of said cooling water, and detecting the temperature output from said sensor; and said cooling water temperature controlling means adjusts said water temperature control valve in such a manner that the temperature of said cooling water detected by said cooling water temperature detecting means follows the target value of the temperature of said cooling water set by said target temperature setting means.

6. The malfunction detecting apparatus for a water temperature control valve according to claim 5, wherein said sensor is provided at a position along a passage from a junction of said radiator passage and said bypass passage to said internal combustion engine.

7. The malfunction detecting apparatus for a water temperature control valve according to claim 1, wherein:

said cooling water temperature detecting means includes a sensor provided to a cooling water passage of said internal combustion engine for outputting the temperature of said cooling water, and detecting the temperature output from said sensor; and said cooling water temperature controlling means adjusts said water temperature control valve in such a manner that the temperature of said cooling water detected by said cooling water temperature detecting means follows the target value of the temperature of said cooling water set by said target temperature setting means.

* * * * *